US007316259B2

(12) United States Patent
Taniguchi

(10) Patent No.: US 7,316,259 B2
(45) Date of Patent: Jan. 8, 2008

(54) DIECASTING MACHINE

(75) Inventor: Yoshiya Taniguchi, Akashi (JP)

(73) Assignee: Toyo Machinery & Metal Co., Ltd., Akashi-shi (JP)

( * ) Notice: Subject to any disclaimer, the term of this patent is extended or adjusted under 35 U.S.C. 154(b) by 0 days.

(21) Appl. No.: 11/432,545

(22) Filed: May 12, 2006

(65) Prior Publication Data

US 2006/0255095 A1 Nov. 16, 2006

(30) Foreign Application Priority Data

May 13, 2005 (JP) ..... 2005-141344

(51) Int. Cl.
*B22D 17/10* (2006.01)

(52) U.S. Cl. ..... 164/312; 164/314

(58) Field of Classification Search ..... 164/113, 164/119, 120, 312, 314
See application file for complete search history.

(56) References Cited

U.S. PATENT DOCUMENTS 7,011,511 B2 * 3/2006 Nishizawa et al. ..... 425/145

FOREIGN PATENT DOCUMENTS

JP 2000-84654 A 3/2000
JP 2001-1126 A 1/2001

* cited by examiner

*Primary Examiner*—Kevin P. Kerns
(74) *Attorney, Agent, or Firm*—Crowell & Moring LLP

(57) ABSTRACT

A diecasting machine is provided with a mold and an injection plunger to inject and fill molten metal in the mold by an advancement of the injection plunger. The diecasting machine includes an electric servomotor and a hydraulic drive source. The electric servomotor is usable as a first drive source capable of driving the injection plunger at an advancing speed lower than 1 m/sec, while the hydraulic drive source is usable as a second drive source capable of driving the injection plunger at an advancing speed not lower than 1 m/sec.

3 Claims, 7 Drawing Sheets

DIECASTING MACHINE

FIELD OF THE INVENTION

This invention relates to a diecasting machine of the type that molten metal is injected and filled in a mold by an advancement of an injection plunger.

DESCRIPTION OF THE BACKGROUND

There are widely known diecasting machines of the type that a molten metal material is injected and filled in a cavity of a mold to obtain a product. With such a diecasting machine, a metal material (for example, Al alloy, Mg alloy or the like) which has been molten in a smelting furnace is metered and lifted out by a ladle upon every shot, and the thus-ladled molten metal (molten metal material) is poured into an injection sleeve and is then injected and filled in a cavity of a mold by an advancement of an injection plunger.

An injection step which is performed by such a diecasting machine generally consists of a low-speed injection step and a high-speed injection step, and in the high-speed injection step, it is necessary to inject and fill molten metal in a mold at a high injection speed which is faster by one digit or so than the injection speed of an injection molding machine for plastics. In general, a relatively large hydraulic drive source has, therefore, been used as an injection drive source conventionally. Reflecting the use of a hydraulic drive source as an injection drive source as mentioned above, hydraulic diecasting machines in which drive sources for mold open and closure and ejection are also designed as hydraulic drive sources have been the mainstream of diecasting machines.

Hydraulic diecasting machines, however, involve the potential risk of smear with oil or the like. There is, accordingly, an increasing desire toward electrically-driven, clean diecasting machines in recent years. Concerning such electrically-driven diecasting machines, there is known, for example, the technology disclosed in JP-A-2000-84654 and JP-A-2001-1126. According to the technology disclosed in these patent publications, a diecasting machine is equipped with an electric servomotor for injection and also with an accumulator as a hydraulic drive source to be used in a pressure-raising step and a pressure-holding step. A low-speed injection step and high-speed-injection step during an injection step are performed only by the drive force of the electric servomotor for injection. The pressure-raising step is performed by combining the drive force of the electric servomotor for injection and that of the accumulator. Further, the pressure-holding step which follows the pressure-raising step is performed only by the drive force of the accumulator. As an alternative, the pressure-raising and pressure-holding steps are performed only by the drive force of the accumulator.

According to the technology disclosed in JP-A-2000-84654 and JP-A-2001-1126 referred to in the above, the electric servomotor is used as the drive source for the injection step (the low-speed injection step and high-speed injection step), and the force of the hydraulic drive source is used only for the pressure-raising and pressure-holding steps. This conventional technology, therefore, makes it possible to make the size of a hydraulic system smaller, to realize a relatively clean diecasting machine, and to readily output a large pressure upon raising the pressure. To achieve a high injection speed in the high-speed injection step, however, this conventional technology relies solely upon the power of the electric servomotor. Accordingly, there is a certain limit to the acceleration of the injection speed, and moreover, a relatively large motor is also required as the electric servomotor to assure the high injection speed.

SUMMARY OF THE INVENTION

With the foregoing in view, an object of the present invention to provide a diecasting machine equipped with an electric servomotor for injection, which assures to achieve a high injection speed with good responsibility in a high-speed injection step.

To achieve the above-described object, the present invention provides, in one aspect thereof, a diecasting machine provided with a mold and an injection plunger to inject and fill molten metal in the mold by an advancement of the injection plunger. The diecasting machine comprises:

an electric servomotor usable as a first drive source capable of driving said injection plunger at an advancing speed lower than 1 m/sec; and a hydraulic drive source usable as a second drive source capable of driving said injection plunger at an advancing speed not lower than 1 m/sec.

In a diecasting machine equipped with an electric servomotor as a drive source for advancing or retracting an injection plunger, it is not a boosted (in other words, raised) pressure but a high injection speed in a high-speed injection step that can be hardly achieved only by the output of the electric servomotor. In the construction having the electric servomotor as a primary drive force for the injection plunger and also the hydraulic drive force as an auxiliary drive source for driving the injection plunger in an advancing direction, the present invention makes it possible to release the power of the hydraulic drive source at once and hence, to advance the injection plunger at high speed. Therefore, a high injection speed can be surely achieved with good responsibility. Further, the injection and filling of molten metal in the mold can be surely conducted in short time, so that castings can be obtained with high quality.

DETAILED DESCRIPTION OF THE PREFERRED EMBODIMENT

The diecasting machine according to the embodiment of the present invention will hereinafter be described with reference to the accompanying drawings.

Figure 1:
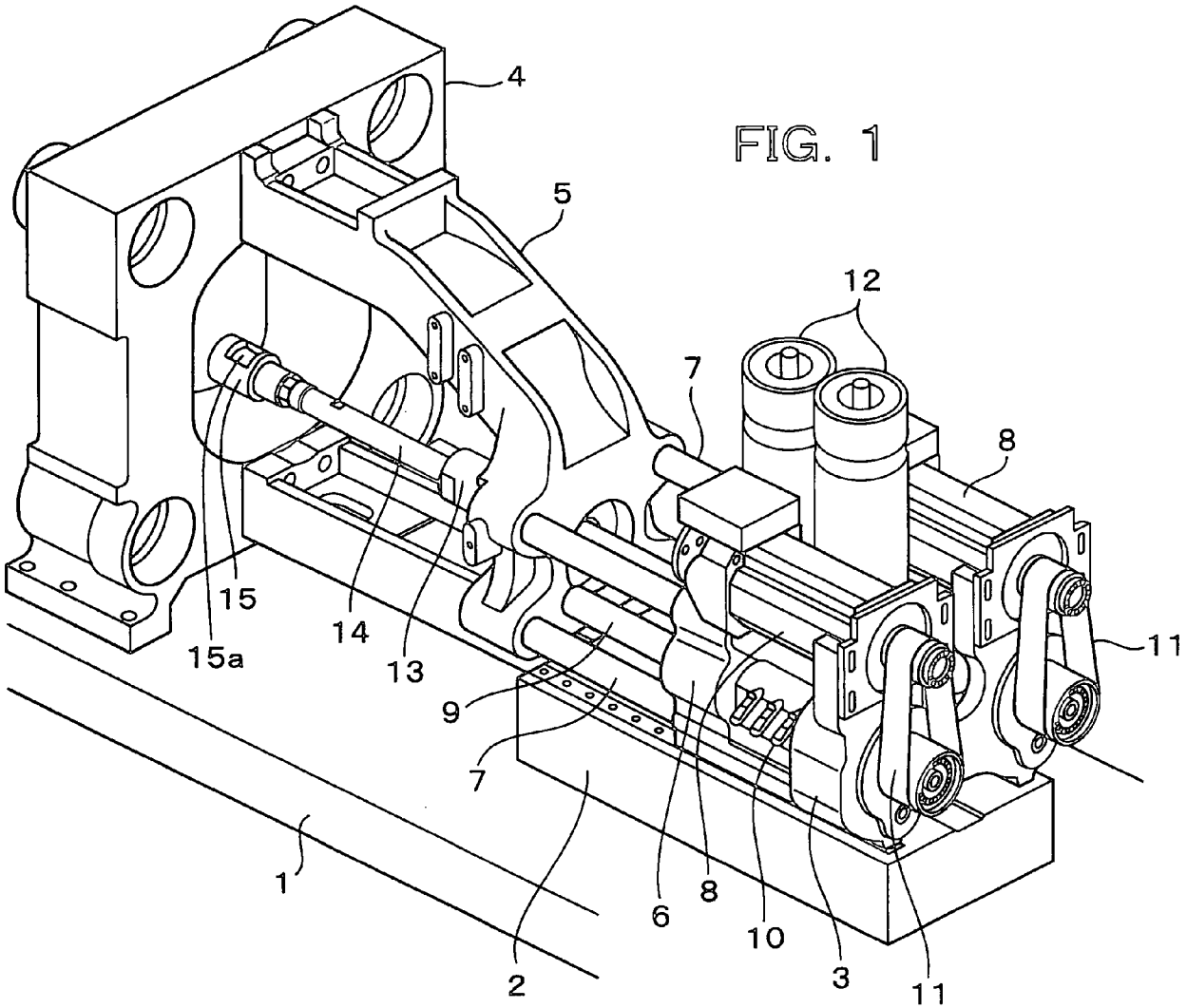
FIG. 1 is a fragmentary perspective view showing primarily an injection mechanism of a diecasting machine according to an embodiment of the present invention.

FIG. 1 shows a main base 1; a base member 2 for the injection mechanism as mounted on the main base 1; a holding block 3 arranged on the base member 2; a stationary die plate 4 arranged on the main base 1; a support member 5 held on the stationary die plate 4, etc.; a movable member 6 arranged movably forward or rearward on the base member 2; plural guide bars 7 arranged extending between the holding block 3 and the support member 5 to guide an advancement or retraction of the movable member 6; a pair of electric servomotors 8 arranged for injection on the holding block 3; a pair of ball screws 9 rotatably held on the holding block 3 such that rotations of the corresponding electric servomotors 8 can be transmitted to them via rotation transmitting systems 11 constructed of pulleys and belts, respectively; nut members 10 constituting ball screw mechanisms in combination with the corresponding ball screws 9, maintained in threaded engagement with the corresponding ball screws, and fixed at end portions thereof on the movable member 6; a pair of boosting accumulators (hereafter referred to as "ACCs") 12 mounted on the movable member 6 such that the boosting accumulators 12 move together with the movable member 6; a hydraulic cylinder 13 arranged integrally with the movable member 6 such that an injection plunger 14, which also acts as a piston member, is movable forward or rearward through an inside of the hydraulic cylinder 13; an injection sleeve 15 arranged on the stationary die plate 4 such that the injection plunger 14 is movable on a side of a free end thereof forward or rearward through an inside of the injection sleeve 15; and a molten metal injection port 15*a* arranged through the injection sleeve 15.

In this embodiment, rotations of the paired electric servomotors 8 are transmitted to the ball screws 9 of the ball screw mechanisms via the rotation transmitting systems 11 to rotate the ball screws 9. As a result, the nut members 10 of the ball screw mechanisms, said nut members 10 being in threaded engagement with the ball screws 9, are axially advanced or retracted, and therefore, the hydraulic cylinder 13 is moved together with the movable member 6 to advance or retract the injection plunger 14. On the other hand, the pressure fluid pressurized in the paired ACCs 12 is fed to an advancing chamber of the hydraulic cylinder 13 via a control valve so that an advancing force (boosting pressure) is applied to the injection plunger 14. Employed as the ball screws 9 of the ball screw mechanisms in this embodiment are those having a diameter of about 100 mm and equipped with a lead of 20 mm or longer. As a consequence, the distance of axial movement of each nut member 10 per rotation of the corresponding ball screw 9 is set at a certain large value or even greater. In other words, the injection plunger 14 is assured to advance or retract at a certain high speed or even higher per rotation of each ball screw 9. In this embodiment, two electric servomotors 8 and two ball screw mechanisms are arranged, and the outputs of the two electric servomotors 8 are combined to axially move the movable member 6 (injection plunger 14). It is, therefore, possible to obtain a large drive force.

With reference to FIGS. 2 through 5, a description will next be made of the construction of a hydraulic system in an injection mechanism of the diecasting machine according to the present invention and the operation of the injection mechanism. In FIGS. 2 through 5, those elements of structure which are the same as the corresponding elements in FIG. 1 are indicated by the same reference numerals.

FIGS. 2 through 5 illustrate a control valve 21 placed in a line, which connects the two ACCs 12 and a first hydraulic chamber (advancing hydraulic chamber) 13*a* of the hydraulic cylinder 13 with each other, and having a direction switching function and a flow-rate controlling function; a cooler 22 placed in a line which connects the control valve 21 and a reservoir 23 with each other; a small-capacity hydraulic pump 24 placed in a line which connects the reservoir 23 and a second hydraulic chamber 13*b* of the hydraulic cylinder 13; a check valve 25 placed in a line 26 which connects the hydraulic pump 24 and the second hydraulic chamber 13*b* of the hydraulic cylinder 13 with each other; a line 27 connecting a line 28, via which the first hydraulic chamber 13*a* of the hydraulic cylinder 13 and the control valve 21 are connected together, with the line 26 on a downstream side of the check valve 25; a check valve 29 placed in the line 27; and a pressure sensor 30 placed in the line 28.

In this embodiment, the control valve 21, check valves 25, 29 and pressure sensor 30 are mounted on the movable member 6 such that they move integrally with the movable member 6, while the cooler 22, reservoir 23 and pump 24 are fixedly arranged. This construction has been adopted to shorten the line length between the ACCs 12 and the hydraulic cylinder 13 with a view to improving the response to each hydraulic drive and also reducing each line loss as much as possible. The above-described construction has also been adopted for another reason that the integral incorporation of (a part of) the hydraulic circuit in the movable member 6 makes it possible to significantly simplify the overall construction compared with the construction in which the hydraulic circuit system is arranged as a discrete unit relative to the movable member 6.

In a state before each injection, the injection plunger 14 is located at the most-retracted position within the hydraulic cylinder 13, the control valve 21 is in the neutral position, a predetermined amount of pressure fluid is stored under a predetermined pressure within the hydraulic chamber of each ACC 12, and at this time, the gas within the gas chamber of each ACC 12 is compressed and raised in pressure by the pressure of the fluid. Including the state before each injection but excluding a step that a small amount of fluid is fed into the second hydraulic chamber 13*b* of the hydraulic cylinder, the hydraulic pump 24 is maintained in a stopped state. In the state before each injection, the nut member 13 is placed at the most-retracted position.

Figure 2:
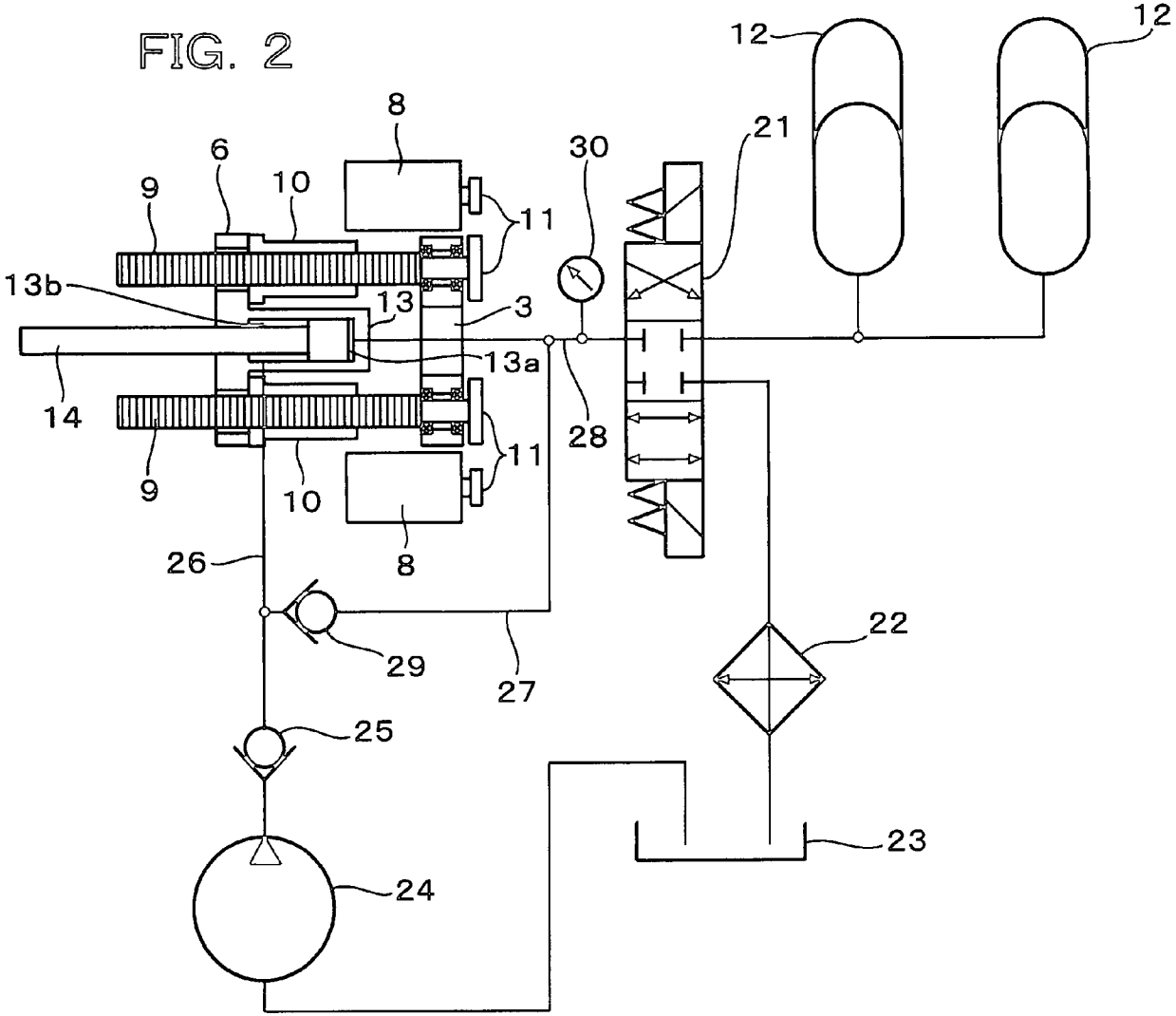
FIG. 2 is a simplified composite diagram of a drive mechanism by an electric servomotor and a hydraulic circuit, which shows the functional constitution of the injection mechanism of the diecasting machine according to the embodiment of the present invention at the time of end of a low-speed injection step.

When the start timing of an injection step is reached in such a state as described above, the electric servomotors 8 are rotatively driven in a predetermined direction at a speed preset for the low-speed injection step on the basis of an instruction from a system controller which governs the control of the whole machine. As a result, the movable member 6, hydraulic cylinder 13 and injection plunger 14 are driven forward at a low speed (which is a speed lower than 1 m/sec and is set, for example, at 0.52 m/sec in this embodiment) together with the nut members 10 of the ball-screw mechanisms. In other words, in the low-speed injection step, the electric servomotors 8 are driven under speed feedback control along a position axis, and as a consequence, the low-speed injection step is performed, the molten metal in the injection sleeve 15 is filled to the runner portion of the mold, and the venting of air from the cavity of the mold is conducted. Further, the system controller recognizes the advanced position of the movable member 6 on the basis of an output from an encoder arranged on the electric servomotor 8, and switches the low-speed injection step to the high-speed injection step at a time advanced by a distance preset for the low-speed injection step. It is to be noted that FIG. 2 illustrates a state at the time of end of the low-speed injection step.

Figure 3:
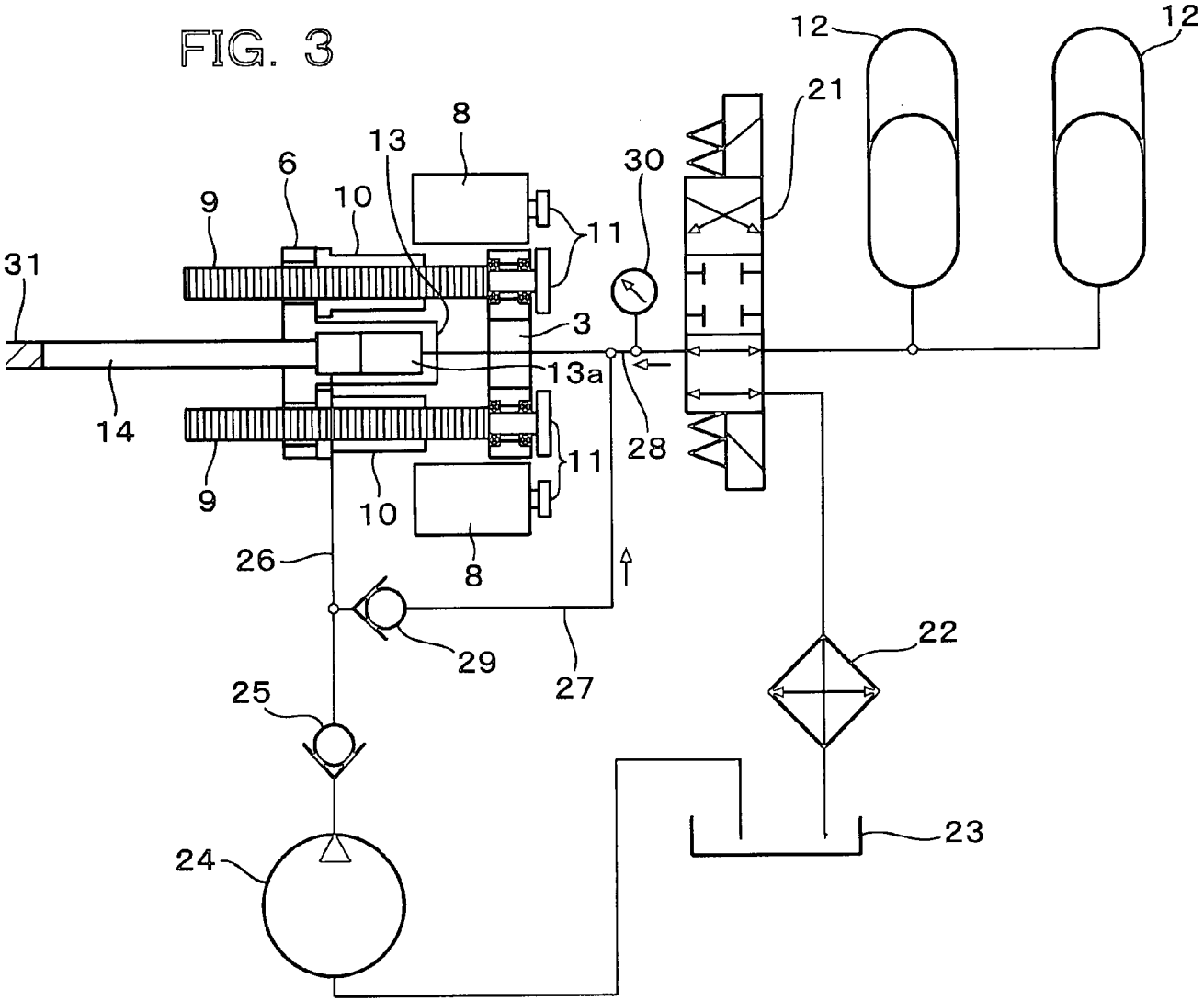
FIG. 3 is a similar simplified composite diagram as FIG. 2, but shows the functional constitution of the injection mechanism of the diecasting machine at the time of end of a high-speed injection step.

When a start timing of the high-speed injection step is reached, the system controller switches the control valve 21 to a lower position as shown in FIG. 3 while controlling the electric servomotor 8 to perform a similar operation as in the low-speed injection step. As a result, the pressure fluid stored in the ACCs 12 is quickly fed to the first fluid chamber (advancing fluid chamber) 13*a* of the injection cylinder 13 via the control valve 21 under the pressure of the gas which has been compressed and raised in pressure. The injection plunger 14 is, therefore, driven forward relative to the movable member 6 at a high speed (which is a speed of 1 m/sec or higher and is set, for example, at 7.48 m/sec in this embodiment). At this time, the pressure fluid in the second fluid chamber 13*b* of the hydraulic cylinder 13 is fed to the first fluid chamber 13*a* of the injection cylinder 13 via the line 26, the check valve 29 and the line 27. In this high-speed injection step, the electric servomotor 8 drives the movable member 6 forward at 0.52 m/sec as in the low-speed injection step. The injection plunger 14 is, therefore, driven forward at a speed as high as 8.0 m/sec in the high-speed injection step, so that molten metal is quickly injected and filled in the cavity of the mold. The system controller then recognizes the advanced position of the movable member 6 on the basis of an output from the encoder arranged on the electric servomotor 8, ends the high-speed injection step at a timing advanced by a distance preset for the high-speed injection step, and switches the high-speed injection step to a boosting step. It is to be noted that FIG. 3 illustrates a state at the time of end of the high-speed injection step. In FIG. 3, numeral 31 designates a biscuit in the injection sleeve 15, which is in contact with a free end of the injection plunger 14.

When the process enters the boosting step, the system controller switches the electric servomotor 8 from the speed feedback control along the position axis in the injection step to pressure feedback control along a time axis. It is to be noted that the term "boosting step" as used herein means one corresponding to the pressure-raising and pressure-holding step in JP-A-2000-84654 and JP-A-2001-1126 referred to in the above and also equivalent to the pressure-holding step in the injection molding of plastics. In this boosting step, the system controller, while controlling the control valve 21 to assume its position shown in FIG. 3, performs the pressure feedback control of the electric servomotor 8 to make the electric servomotor 8 output a pressure which is equal to a boosted pressure preset for the boosting step. By this boosting step, a high pressure (for example, 50 tons or so at the maximum) is applied to the metal, which has begun to solidify in the mold, from the injection plunger 14 via the biscuit 31, and as a result of solidification and shrinkage of the metal, the injection plunger 8 advances a little at a creep speed from its position in FIG. 3. Upon recognition of the end timing of the boosting step on the basis of time monitoring, the system controller switches the boosting step to the cooling step.

It is to be noted that in this embodiment, the boosting step is designed to be performed under multi-stage pressure feedback control in which the pressure is set in multiple stages. By this multi-stage pressure feedback control, this embodiment is designed to realize a boosting operation which can significantly contribute to precision and high-quality casting.

Figure 4:
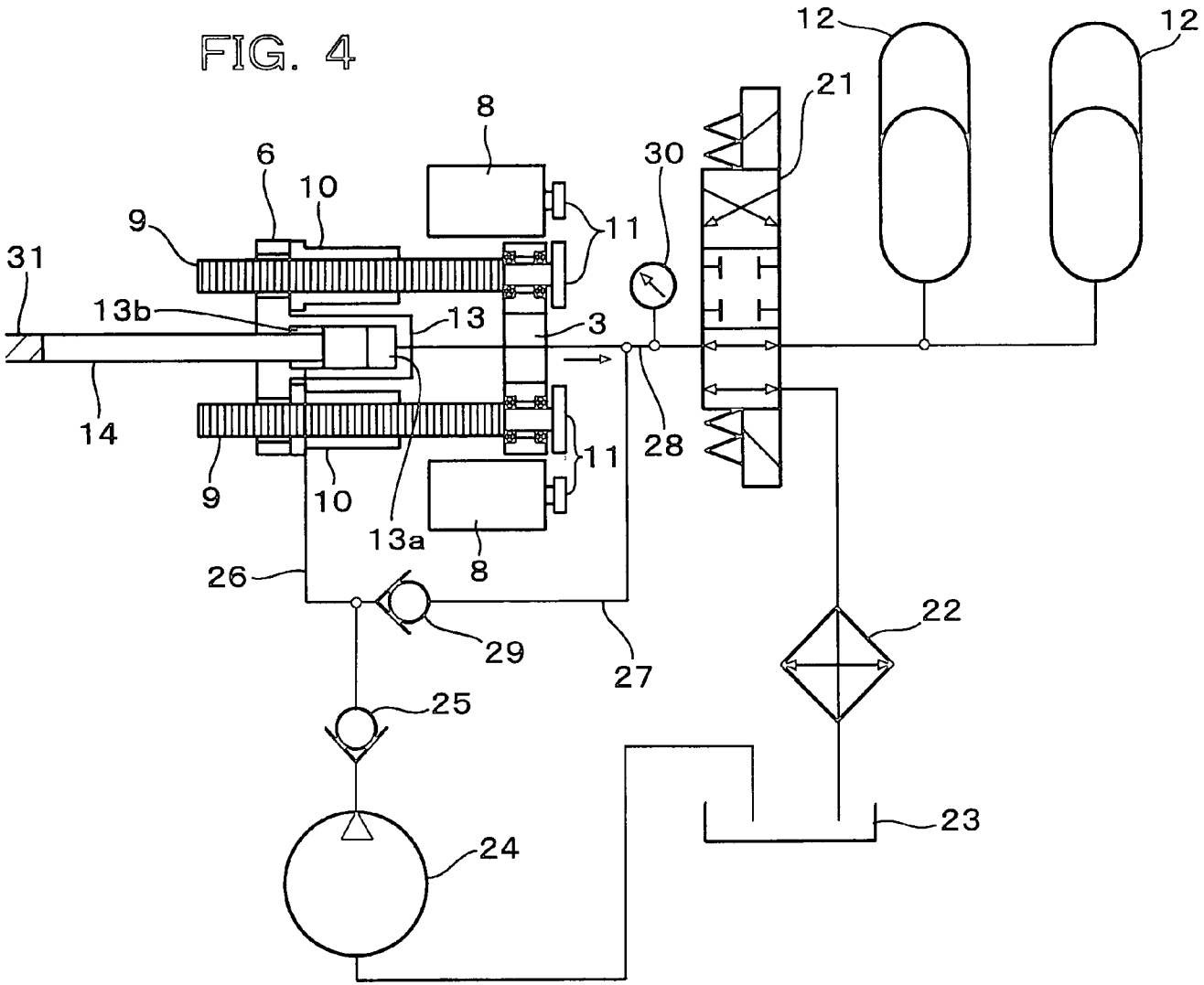
FIG. 4 is a similar simplified composite diagram as FIGS. 2 and 3, but shows the functional constitution of the injection mechanism of the diecasting machine at a stage in the course of a cooling step.
Figure 5:
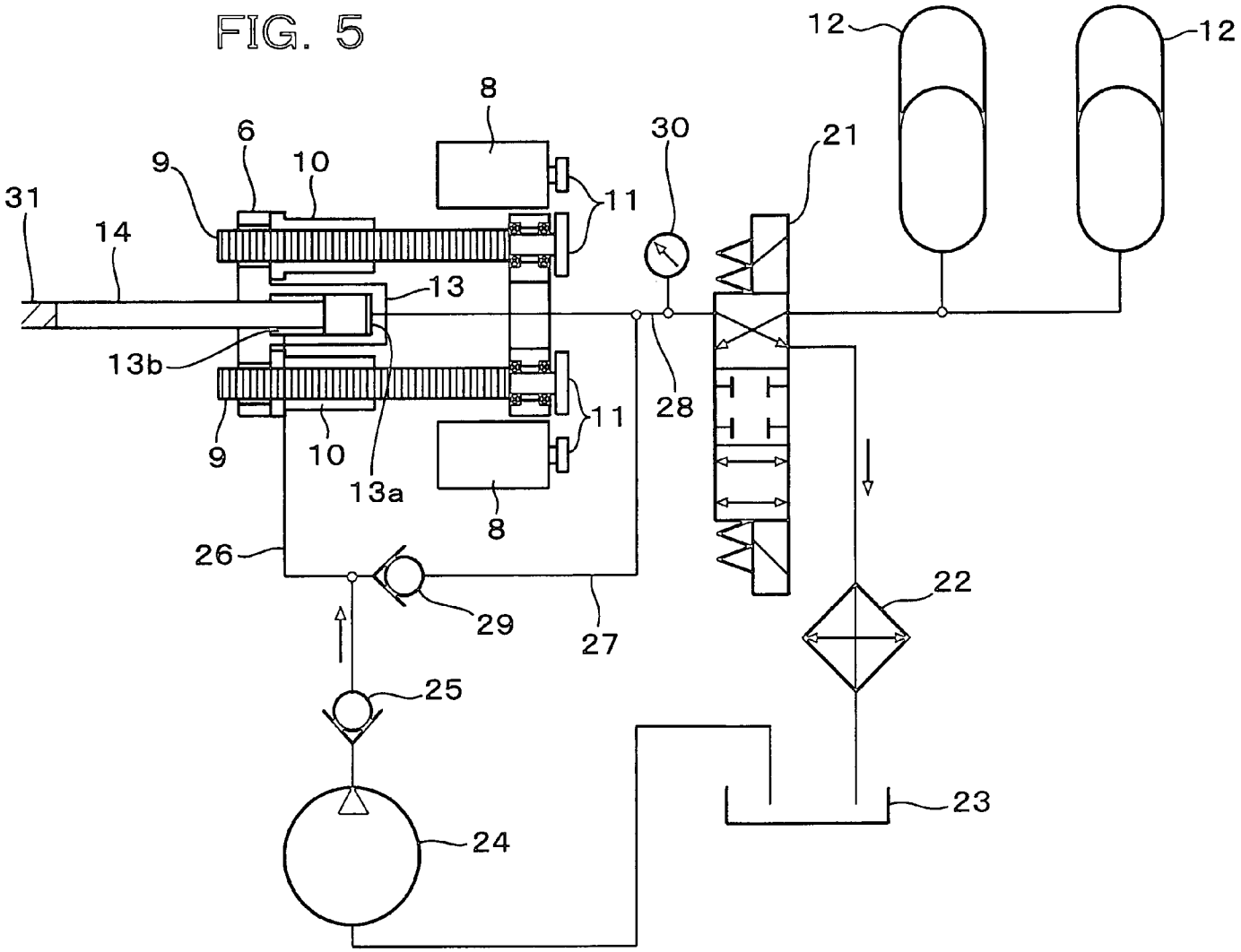
FIG. 5 is a similar simplified composite diagram as FIGS. 2 to 4, but shows the functional constitution of the injection mechanism of the diecasting machine at a stage advanced further than the stage of FIG. 4 in the course of the cooling step.

In the cooling step, the system controller drives the electric servomotor 8 forward under speed feedback control along the position axis to advance the movable member 6 while controlling the control valve 21 to assume its position shown in FIG. 3 (i.e., the lower position in the drawing). By this advancement of the movable member 6, a force is applied in the advancing direction to the injection plunger 14. As the biscuit 31 is in contact with the free end of the injection plunger 14, the injection plunger 14 cannot advance, but on the contrary, retracts against the fluid pressure. As a consequence, the pressure fluid is returned from the first fluid chamber 13*a* of the injection cylinder 13 to the fluid chamber of each ACC 12 via the control valve 21 as shown in FIG. 4. As a result, the gas in the gas chamber of each ACC 12 is compressed and raised in pressure. At the timing that a predetermined amount of pressure fluid has been stored at a predetermined pressure in the fluid chamber of each ACC 12 (in other words, pressure fluid has been stored sufficiently for the above-described high-speed injection step), the system controller switches the control valve 21 to the upper position as shown in FIG. 5. As a result, in an amount equal to the fluid flowed out of the second fluid chamber 13*b* of the hydraulic cylinder 13 in the high-speed injection step, fluid is returned to the reservoir 23 via the control valve 21 and the cooler 22. Subsequently, the system controller drives the hydraulic pump 24 under control such that in an amount equal to the fluid flowed out of the second fluid chamber 13*b* of the hydraulic cylinder 13 in the high-speed injection step, fluid is fed from the hydraulic pump 24 to the second fluid chamber 13*b* of the hydraulic cylinder 13. At the timing that the injection plunger 14 has reached the most-retracted position within the hydraulic cylinder 13, the system controller stops the hydraulic pump 24, and further, switches the control valve 21 to the neutral position, stops the electric servomotor 8, and awaits the end timing of the cooling step. At this time, the free end of the injection plunger 14 is in contact with the biscuit 31.

When the amount of the fluid stored in the two ACCs 12 is 1.3 liters, for example, the amount of the fluid replenished from the hydraulic pump 24 to the second fluid chamber 13*b* of the hydraulic cylinder 13 is as little as 0.6 liter or so in the above-described cooling step. A hydraulic pump of very small capacity and a small cooler can, therefore, be arranged as the hydraulic pump 24 and the cooler 22, respectively, thereby making it possible to achieve a substantial energy saving. In addition, a substantial volume reduction is also feasible concerning the reservoir 23. In this respect, it is also possible to make a contribution to the compaction of the hydraulic circuit system.

When the cooling step ends, the system controller performs a mold opening step as will be described subsequently herein. In synchronization with this mold opening operation, the system controller also drives the electric servomotor 8 under speed feedback control along the position axis to advance the movable member 6. In this manner, a biscuit ejection step that the biscuit 31 is ejected by the injection plunger 14 is performed in synchronization with the opening of the mold.

At a suitable timing after the end of the biscuit ejection step, the system controller performs a step to retract the injection plunger 14, and also drives the electric servomotor 8 in a retracting direction under speed feedback control along the position axis to retract the movable member 6. Further, at the timing that the movable member 6 has retracted to the most-retracted position, the system controller stops the electric servomotor 8.

Figure 6:
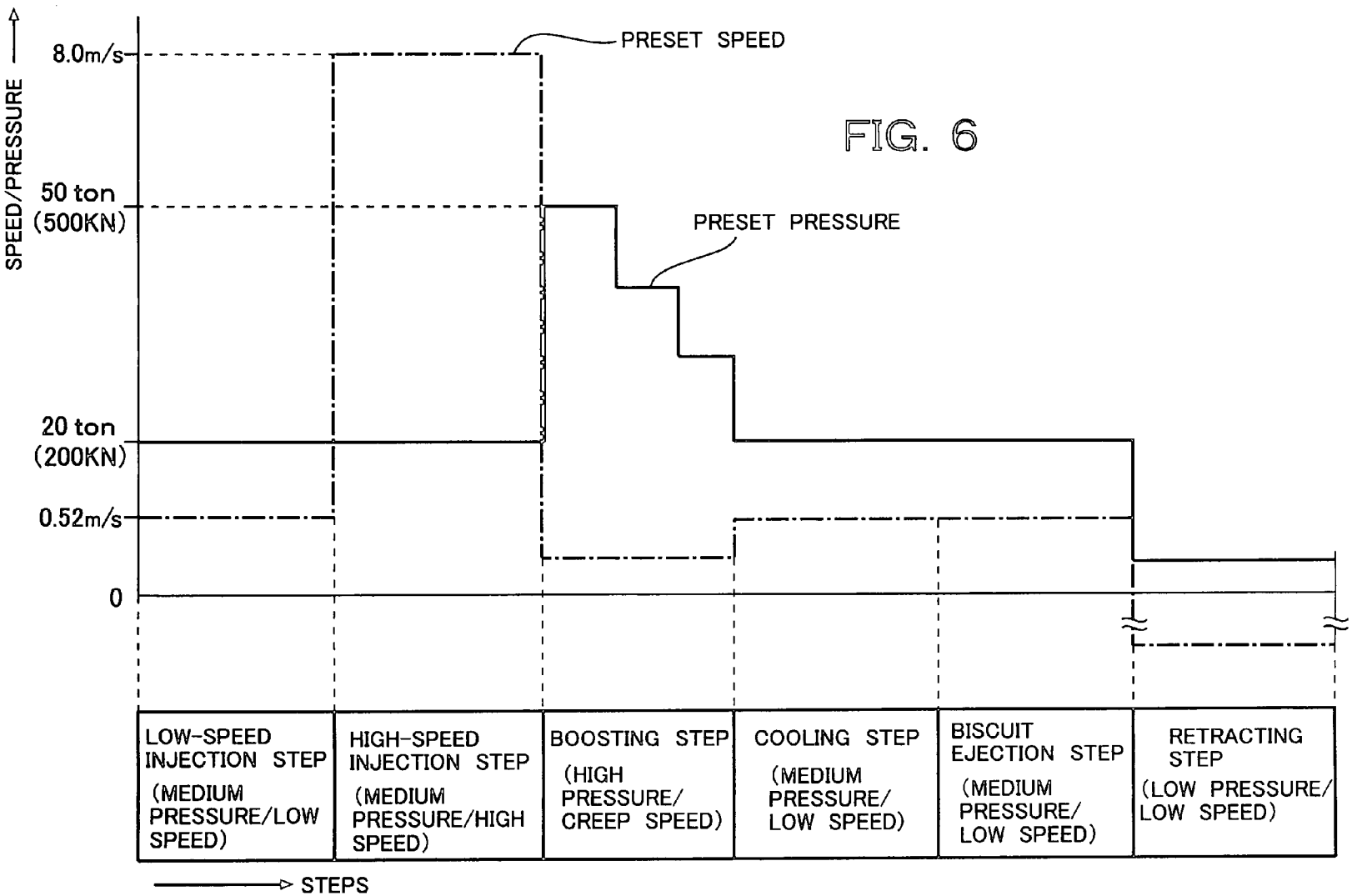
FIG. 6 is a diagram illustrating preset speeds and preset pressures versus steps relevant to various operations by the injection mechanism in the diecasting machine according to the embodiment of the present invention.

Referring next to FIG. 6, the preset speed is a value preset to perform the speed feedback control of the electric servomotor 8 except for the high-speed injection step and boosting step, and the speed preset for the electric servomotor 8 in the high-speed injection step is the same as the value preset for the low-speed injection step. Concerning the preset pressure, on the other hand, it is only the boosting step that the pressure is set for performing the pressure feedback control.

Figure 7:
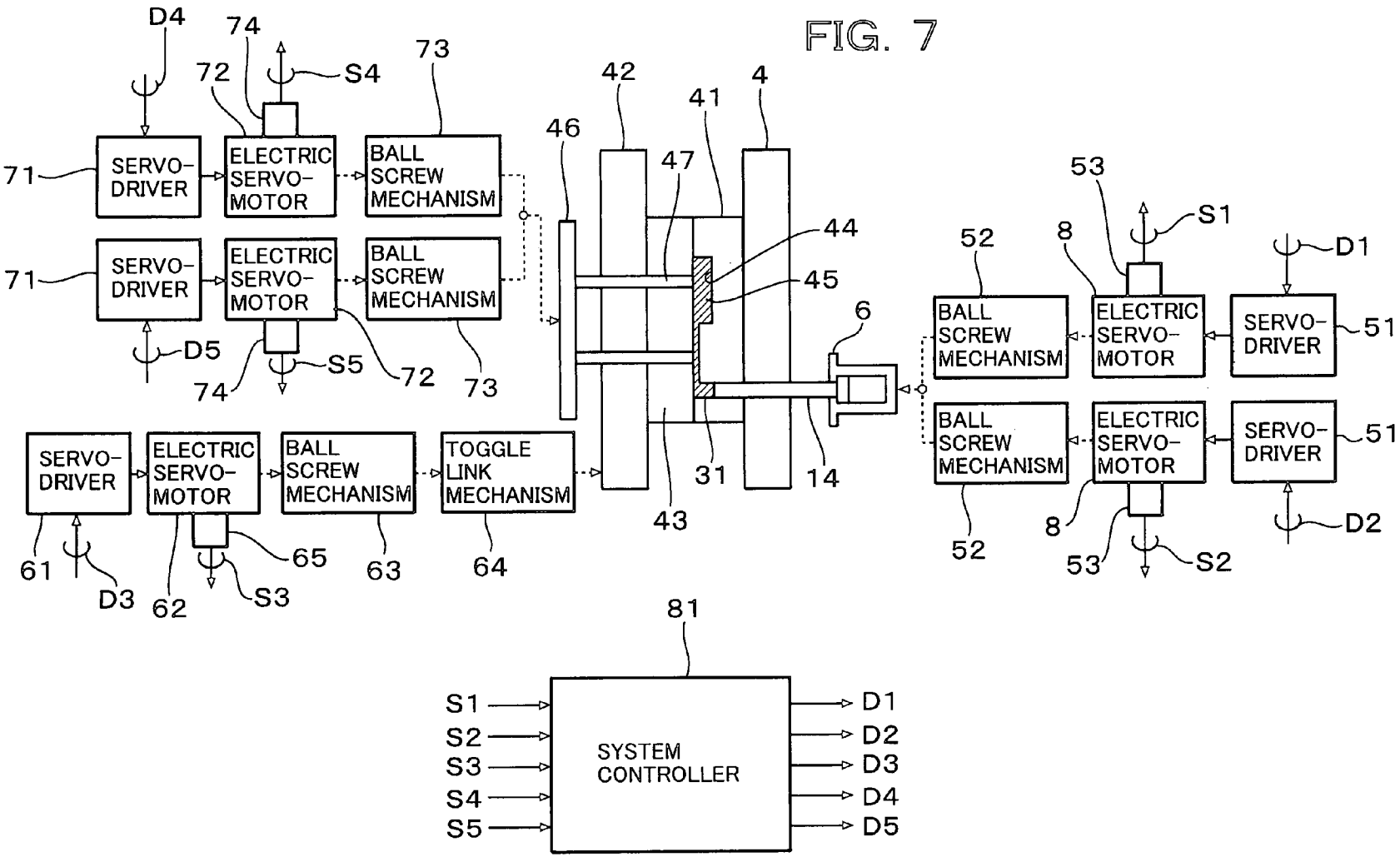
FIG. 7 is a block diagram showing, in a simplified form, the construction of an injection system, mold open and close system and ejection system in the diecasting machine according to the embodiment of the present invention.

FIG. 7 depicts a stationary mold 41 mounted on the stationary die plate 4; a movable die plate 42 movable forward or rearward while being guided by unillustrated tie bars; a movable mold 43 mounted on the movable die plate 42; a cavity 44 defined by both of the molds 41,43 in closed positions; a metal material 45 filled in the cavity 44, etc.; an ejection member 46 movable forward or rearward relative to the movable die plate 42; and ejection pins 47 integral with the ejection member 46.

Also illustrated are a pair of servodrivers 51 for driving and controlling the respective electric servomotors 8 for injection, respectively; a pair of ball screw mechanisms 52 for converting rotations of the respective electric servomotors 8 for injection into linear motions, respectively; and encoders 53 arranged on the respective electric servomotors 8 for injection, respectively, to output detection signals S1, S2.

Further illustrated are a servodriver 61 for driving and controlling the mold opening/closing motor; an electric servomotor 62 for opening and closing the mold; a ball screw mechanism 63 for converting rotations of the mold opening/closing electric servomotor into linear motion; a toggle link mechanism 64 for being driven by the linear motion of the ball screw mechanism 63 to expand or contract such that the movable die plate 42 is moved forward or rearward; and an encoder 65 arranged on the mold opening/closing electric servomotor 62 to output a detection signal S3.

Still further illustrated are a pair of servodrivers 71 for driving and controlling ejection motors, respectively; a pair of electric servomotors 72 for ejection; a pair of ball screw mechanisms 73 for converting rotations of the respective electric servomotors 71 for ejection into linear motions to move the ejection member 46 and ejection pin 47 forward or rearward; and encoders 74 arranged on the respective electric servomotors 71 for ejection, respectively, to output detection signals S4,S5.

Yet still further illustrated is a system controller 81, which governs the control of the whole diecasting machine, and upon receipt of the respective detection signals S1-S5 or the like, delivers command signals D1-D5 to the respective servodrivers to control the operations of the injection system, mold opening/closing system, and ejection system.

As shown in FIG. 7, the diecasting machine of this embodiment is constructed as an electrically-driven machine except that the hydraulic circuit is mounted as only a part of the injection system as mentioned above, and therefore, has realized a clean machine reduced as much as possible in the potential problem of smear with fluid or the like. Further, the system controller 81 monitors the conditions of the whole machine, specifically monitors the position of the movable die plate 42 and the position of the injection plunger 14 to perform the biscuit ejection step and the opening of the mold in synchronization with each other such that the ejection of the biscuit and the opening of the mold are performed while making their speeds equal. Accordingly, the opening of the mold can be performed while assuring the parting of the metal material 44 from the side of the stationary mold 41 and also assuring the metal material 44 to remain only on the side of the movable mold 43.

Although a large force is required in the biscuit ejection step, this embodiment can easily obtain a force sufficient for the ejection of the biscuit 31 without arrangement of large-capacity electric servomotors as the individual electric servomotors 8 for injection because the injection system is designed as the twin-electric motor system. Similarly to the ejection operation, a large force is required for the ejection of the metal material 44 remaining on the movable mold 43. Since the ejection system is designed as the twin-electric motor system in this embodiment, an ejection force can be easily obtained as much as needed without arrangement of large-capacity electric servomotors as the individual electric servomotors 8 for ejection.

This application claims the priority of Japanese Patent Application 2005-141344 filed May 13, 2005, which is incorporated herein by reference.

The invention claimed is:

1. A diecasting machine provided with a mold and an injection plunger to inject and fill molten metal in said mold by an advancement of said injection plunger, comprising:

an electric servomotor usable as a first drive source capable of driving said injection plunger at an advancing speed lower than 1 m/sec;

a hydraulic drive source usable as a second drive source capable of driving said injection plunger at an advancing speed not lower than 1 m/sec; and an accumulator mounted on the machine as said hydraulic drive source; wherein in a low-speed injection step during an injection step, said injection plunger is driven forward by only said electric servomotor; and in a high-speed injection step during an injection step, said injection plunger is driven forward by said hydraulic drive source and said electric servomotor.

2. A diecasting machine according to claim 1, wherein said hydraulic drive source advances or retracts integrally with a movable member which advances or retracts by a drive force of said electric servomotor.

3. A diecasting machine according to claim 1, further comprising a ball screw mechanism for converting rotation of said electric servomotor into linear motion, said ball screw mechanism comprising a ball screw a lead of which is at least 20 mm long.

* * * * *